United States Patent [19]

Hill, II et al.

[11] 4,075,781

[45] Feb. 28, 1978

[54] FLYING DISK

[76] Inventors: Richard D. Hill, II, 2933 Mun Pier Road, Shreveport, La. 71119; Carl T. Mastronuzzi, Jr., 1163 Gilbert St., Bossier City, La. 71112

[21] Appl. No.: 758,077

[22] Filed: Jan. 10, 1977

[51] Int. Cl.[2] ..... A63H 27/00

[52] U.S. Cl. ..... 46/74 D

[58] Field of Search ..... 46/74 D, 75; 273/106 B

[56] References Cited

U.S. PATENT DOCUMENTS

| | | | |
|---|---|---|---|
| D. 221,453 | 8/1971 | Swanberg | D34/15 |
| 3,852,910 | 12/1974 | Everett | 46/74 D |
| 3,935,663 | 2/1976 | Leibowitz | 46/74 D |
| 3,939,602 | 2/1976 | Burke et al. | 46/74 D |

*Primary Examiner*—Louis G. Mancene
*Assistant Examiner*—Mickey Yu
*Attorney, Agent, or Firm*—John M. Harrison

[57] ABSTRACT

A flying disk characterized by a saucer-shaped hull having a convex top and a concave bottom surface and fitted with three side ports jointly defined by the rim of the disk and by the rear edges of three airfoils attached to the rim and the concave bottom surface of the disk. The airfoils are cupped and extend inwardly toward the center of the disk. A tubular central port is provided in the center of the hull and the tips and mounted portions or legs of the triangularly shaped, inwardly extending airfoils are positioned in planar relationship with the bottom opening of the central port. Aerodynamic lift is achieved when the disk is thrown forward with a spinning motion as low pressure is created on the convex upper surfaces of the disk hull and the cupped airfoils, while high pressure is created on the bottom concave surfaces of the hull and airfoils.

11 Claims, 6 Drawing Figures

FLYING DISK

BACKGROUND OF THE INVENTION

1. Field of the Invention

This invention relates to aerodynamic toys, and more particularly to a saucer-shaped, aerodynamic flying disk which is provided with cupped airfoils to enhance flying performance. In the recent past, toys shaped in the form of inverted saucers and disks which are adapted for throwing with a spinning motion have enjoyed great popularity among people of all ages. Generally, such a flying toy is formed or molded from a plastic material and is cupped or disk-shaped to resemble an airfoil and to provide aerodynamic lift. In use, the toy is generally grasped with the thumb on the convex or upper side of the disk surface and one or more fingers on the concave bottom side, and is thrown with a wrist snapping motion to cause the disk to spin as it moves forward, and to fly or glide toward another participant. In the alternative, the disk may be thrown toward a prescribed target and can be made to exhibit certain aerodynamic maneuvers while in flight, depending upon the speed and direction of throwing and the prevailing wind velocity and direction.

2. Description of the Prior Art

Toy flying saucers or disks are well known commercially in the prior art and have been marketed under such trademarks as the mark "FRISBEE". Typical of the patents which have issued on such devices is U.S. Pat. No. 3,724,122 to Richard L. Gillespie, Sr. which discloses a saucer-shaped throwing disk which is characterized by a circular rim portion and a crown section and is shaped to create a trough or depression in order to provide a low profile and permit the saucer or disk to "fly" at a relatively high speed when thrown. A similar device is disclosed in U.S. Pat. No. 3,742,643 to Charles D. Keith which includes a hub, an intermediate ring and a concentric outer ring, and radially extending vanes of variable pitch disposed between the hub and the inner ring to permit adjustment of the aerodynamic function and vary performance of the disk as it is thrown. Yet another adaptation of the free flying disk toy can be found in U.S. Pat. No. 3,935,663 to Martin N. Leibowitz which includes a flying disk having a series of vent openings formed symmetrically around the disk in order to create additional lift. The toy is also equipped with a circular reel attached to the center of the convex, outer hull surface to allow a flexible line to be wound around the reel and spun in order to create a faster spin as the toy disk is thrown through the air.

Accordingly, it is an object of this invention to provide a new and improved flying disk which is characterized by a hull having a convex upper surface and a concave bottom or lower surface and three side ports which are each defined by the rim of the disk and by one of three curved airfoils which are designed to impart additional lift to the disk.

Another object of this invention is to provide a new and improved flying disk which includes a saucer-shaped hull having three side ports and three airfoils tucked under the hull, which disk can be molded of a suitable material such as plastic or fiberglass and is capable of performing a variety of aerodynamic maneuvers depending upon the speed and angle of throw.

Yet another object of this invention is to provide a flying disk or saucer which is characterized by a convex upper hull surface and a concave lower surface and three airfoils which are disposed on the hull adjacent the concave bottom hull surface, the convex upper surfaces of the airfoils being located in spaced relationship from the concave bottom surface of the disk, and the rear edges of the airfoils defining the top sides of three side ports which are provided in the disk.

A still further object of the invention is to provide a flying disk characterized by a saucer-shaped hull having three side ports, a tubular central port, and three essentially triangular shaped, cupped airfoils, two legs of which are mounted on the hull rim and the third leg of which projects inwardly in planar relationship with the bottom end of the tubular central port.

SUMMARY OF THE INVENTION

These and other objects of the invention are provided in a flying disk which is characterized by an inverted saucer-shaped hull having a convex upper surface and a concave bottom surface, and is further characterized by three side ports, a tubular central port extending downwardly from the concave bottom surface of the hull, and three substantially triangular shaped, cupped airfoils positioned in spaced relationship on the underside of the disk with two legs of each airfoil attached to the rim of the disk and the third leg or tip projecting inwardly toward the center of the disk. The unattached, projecting tips of the airfoils are in planar relationship with the attached legs and with the bottom end of the downwardly extending central port, and in a preferred embodiment, the disk is further characterized by a groove in the inside peripheral surface of the hull rim to enhance air flow characteristics over the airfoils and through the side ports and central port.

BRIEF DESCRIPTION OF THE DRAWINGS

The invention will be better understood by reference to the following drawing, in which.

DESCRIPTION OF THE PREFERRED EMBODIMENTS

Figure 1:
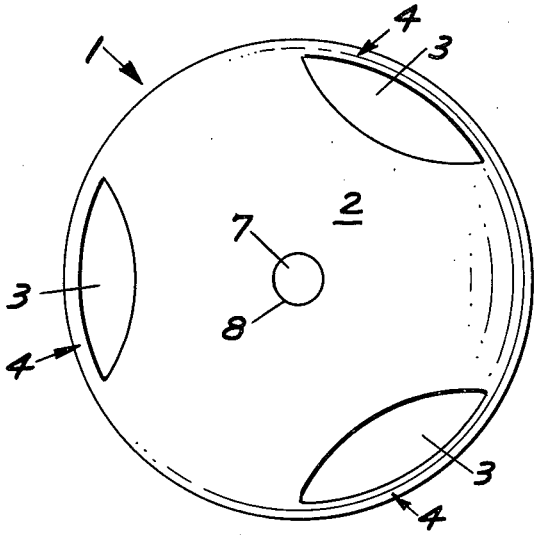
FIG. 1 is a top plan view of the flying disk of this invention.

Referring now to FIG. 1 of the drawing, the flying disk of this invention is generally illustrated by reference numeral 1 and is characterized by hull 2, which is preferably of substantially uniform cross-section, and the upper surface of which is convex in shape, as illustrated. Side ports 3 are generally elliptical in shape and are illustrated in spaced relationship in hull 2, in close proximity to rim 4, which defines the bottom portion of side ports 3. Central port 7 is provided in the center of hull 2 and is defined by central port tube 8 which projects downwardly through hull 2, the top of central port tube 8 being coextensive with the convex upper surface of hull 2, and the bottom extending downwardly with bottom end 15 of central port tube 8 positioned in planar relationship with the rim bottom 6 of rim 4.

Figure 2:
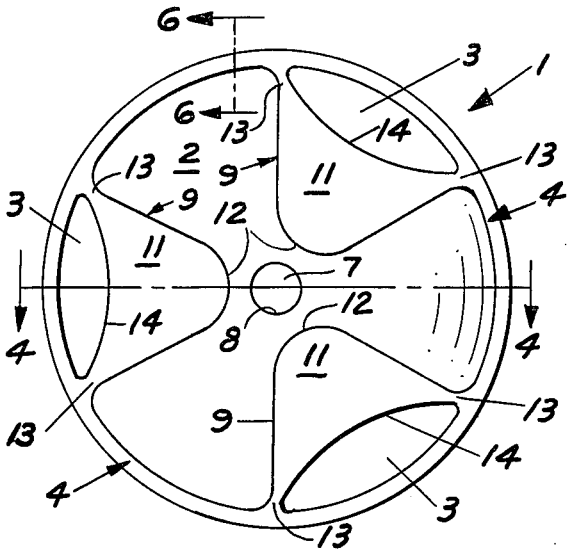
FIG. 2 is a bottom plan view of the flying disk illustrated in FIG. 1.
Figure 4:
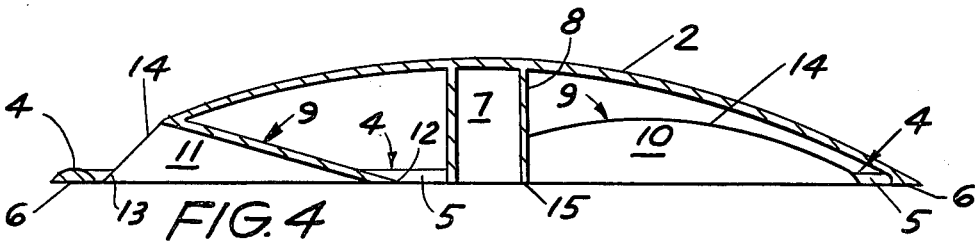
FIG. 4 is a sectional view of the flying disk taken along lines 4—4 in FIG. 2.
Figure 5:
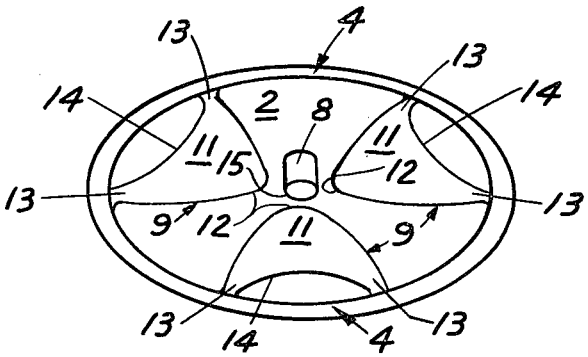
FIG. 5 is a perspective view of the underside of the flying disk illustrated in FIG. 2.

Referring now to FIGS. 2, 4 and 5 of the drawing, the lower surface of hull 2 is concave in shape, as illustrated, with central port 7, defined by central port tube 8, located in the center of hull 2, and three airfoils 9 positioned in spaced relationship on the underside of hull 2. Airfoils 9 are essentially triangularly shaped, as illustrated, and are cupped to form a top surface 10 which is convex in shape, and a concave bottom surface 11. The curvature of airfoils 9 serves to define the top side or portion of side ports 3, since each of airfoils 9 is attached to the concave lower surface of hull 2 along rear edges 14. The tips 12 of airfoils 9 extend inwardly of hull 2 opposite rear edges 14, and project toward central port tube 8 in the same plane as bottom end 15 of central port tube 8, as illustrated in FIG. 4 of the drawing. As further illustrated in FIGS. 2 and 5 of the drawing, airfoils 9 are in braced attachment to the underside of hull 2 by means of legs 13, which are mounted on rim 4 of hull 2, and which are in planar relationship with tips 12 of airfoils 9 and the bottom end 15 of central port tube 8, at the point of attachment to rim 4.

Figure 6:
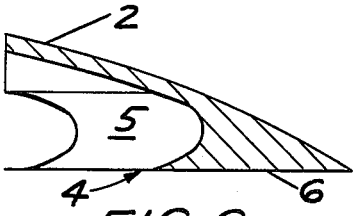
FIG. 6 is a sectional view of a preferred hull and rim section of the flying disk, taken along lines 6—6 in FIG. 2.

Referring now to FIGS. 4 and 6 of the drawing, it will be appreciated that in a preferred embodiment of the invention, rim 4 is somewhat thicker than hull 2, and is provided with rim groove 5 in areas where hull 2 joins rim 4 to help channel air and therefore enhance the aerodynamic characteristics of flying disk 1. Furthermore, the cross-section of those lengths of rim 4 which define the lower side of side ports 3 is preferably hemispherical in shape, as illustrated in FIG. 4. It will also be appreciated that hull 2 of flying disk 1 is preferably formed in one piece with rim 4 and airfoils 9, as also illustrated in FIGS. 4 and 6 of the drawing.

Operation of the flying disk is effected by placing the thumb on the convex upper section of hull 2 and the fingers on the concave bottom portion and thrusting the disk forward with a spinning motion, which rotation sustains lift. Referring again to the drawing, this lift is realized by creation of a low pressure on the convex upper surface of hull 2 and on the convex top surfaces 10 of airfoils 9, with a corresponding high pressure on the concave lower surface of hull 2 and on the concave bottom surfaces 11 of airfoils 9. Central port 7 serves to stabilize flying disk 1 by permitting an air flow from the bottom of flying disk 1 to the top to eliminate the formation of vortices on airfoils 9 and adjacent the concave lower surface of hull 2. In a preferred embodiment of the invention and as previously discussed, rim groove 5 serves to channel air flowing in the concave bottom surface of hull 2 during rotation of the disk, and as this directed air approaches airfoils 9 it is caused to flow over the convex top surfaces 10 to create a portion of the desired lift. Additional lift is, of course, generated as a result of the flow of air over the convex upper surface, and across the concave lower surface of hull 2, which flow creates a characteristic pressure differential. Furthermore, as heretofore stated, during the spinning of flying disk 1, air flows upwardly through central port 7 to permit a smooth movement of air from the undersurface of flying disk 1 in order to help achieve the necessary pressure differential to create enhanced stability.

Figure 3:
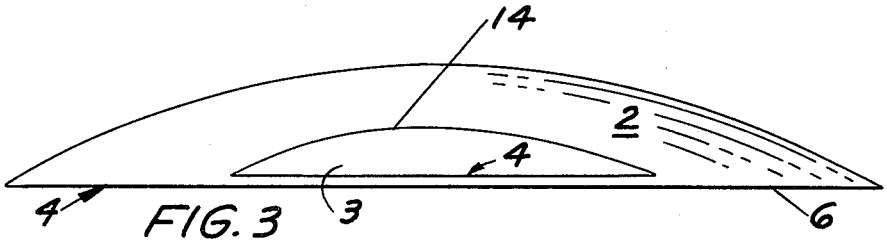
FIG. 3 is an elevation of the flying disk illustrated in FIGS. 1 and 2.

Referring now to FIG. 3 of the drawing, it is apparent that the curvature of hull 2 is such that a minimal elevational profile is presented to enhance movement of flying disk 1 through the air and minimize drag. Furthermore, air flow across airfoils 9 is greatly enhanced by the presence of side ports 3, since as flying disk 1 rotates, air is forced into these ports and caused to flow over top surfaces 10 and across bottom surfaces 11 of cupped airfoils 9 in order to generate additional aerodynamic lift. Since additional lift is available due to the presence of airfoils 9, flying disk 1 can be made to perform a wide variety of aerodynamic maneuvers, depending upon the degree of spin and momentum imparted in throwing the disk, and also depending upon the direction and attitude of throw and angle of attack of the disk relative to the prevailing wind direction.

The flying disk of this invention can easily be formed of fiberglass, or in conventional manner from a plastic material such as injection molded polyethylene, the latter of which permits a high degree of flexibility and resistance to damage, coupled with sufficient structural integrity and rigidity to maintain the desired aerodynamic configuration.

Having described my invention with the particularity set forth above, what is claimed is:

1. A flying disk comprising a generally saucer-shaped hull having a convex upper surface, a concave lower surface, and a rim defining the peripheral outer edge of said hull; a central port or opening defined by a central port tube extending through said hull downwardly from said concave lower surface, the bottom end of said tube in planar relationship with the bottom edge of said rim; three cupped airfoils mounted in spaced relationship on said rim and on said concave lower surface, and each having a convex top surface and a concave bottom surface narrowing to form a tip, said tip of said airfoils projecting toward said central port tube; and three side ports disposed in spaced relationship in said hull adjacent said rim and defined by said rim and said airfoils.

2. The flying disk of claim 1 further comprising a groove formed in the inner peripheral surface of said rim coextensive with said hull to channel air over said airfoils when said disk is flying.

3. The flying disk of claim 1 wherein the cross-section of said rim coextensive with said side ports is hemispherical in shape.

4. The flying disk of claim 1 further comprising a groove formed in the inner peripheral surface of said rim coextensive with said hull to channel air over said airfoils when said disk is flying, and wherein the cross-section of said rim coextensive with said side ports is hemispherical in shape.

5. The flying disk of claim 1 wherein said airfoils are substantially triangular in shape, with two legs of each of said airfoils attached to said rim and said tip of said airfoils in planar relationship with the bottom end of said central port tube and said two legs of each of said airfoils.

6. The flying disk of claim 1 further comprising a groove formed in the inner peripheral surface of said rim coextensive with said hull to channel air over said airfoils when said disk is flying and wherein said airfoils are substantially triangular in shape, with two legs of each of said airfoils attached to said rim and said tip of said airfoils in planar relationship with the bottom end of said central port tube and said two legs of each of said airfoils.

7. The flying disk of claim 1 wherein said hull is of substantially uniform cross-section.

8. The flying disk of claim 1 further comprising a groove formed in the inner peripheral surface of said rim coextensive with said hull to channel air over said airfoils when said disk is flying and wherein:

(a) the cross-section of said rim coextensive with said side ports is hemispherical in shape;

(b) said airfoils are substantially triangular in shape, with two legs of each of said airfoils attached to said rim and said tip of said airfoils in planar relationship with the bottom end of said central port tube and said two legs of each of said airfoils; and (c) said hull is of substantially uniform cross-section.

9. The flying disk of claim 5 wherein said side ports are defined by said rim and by the curved rear edges of said airfoils located between said two legs and attached to said concave lower surface of said hull.

10. The flying disk of claim 1 wherein said rim is thicker than said hull.

11. The flying disk of claim 1 further comprising a groove formed in the inner peripheral surface of said rim coextensive with said hull to channel air over said airfoils when said disk is flying and wherein:

(a) the cross-section of said rim coextensive with said side ports is hemispherical in shape;

(b) said airfoils are substantially triangular in shape, with two legs of each of said airfoils attached to said rim and said tip of said airfoils in planar relationship with the bottom end of said central port tube and said two legs of each of said airfoils;

(c) said hull is of substantially uniform cross-section;

(d) said side ports are defined by said rim and by the curved rear edges of said airfoils located between said two legs and attached to said concave lower surface of said hull; and (e) said rim is thicker than said hull.

* * * * *